US008432337B2

(12) United States Patent
You et al.

(10) Patent No.: US 8,432,337 B2
(45) Date of Patent: Apr. 30, 2013

(54) METHOD OF CONTROLLING LUMINANCE OF A LIGHT SOURCE AND DISPLAY APPARATUS FOR PERFORMING THE METHOD

(75) Inventors: Bong-Hyun You, Gyeonggi-do (KR); Jae-Sung Bae, Gyeonggi-do (KR); Jai-Hyun Koh, Gyeonggi-do (KR)

(73) Assignee: Samsung Display Co., Ltd. (KR)

( * ) Notice: Subject to any disclaimer, the term of this patent is extended or adjusted under 35 U.S.C. 154(b) by 234 days.

(21) Appl. No.: 12/973,648

(22) Filed: Dec. 20, 2010

(65) Prior Publication Data

US 2011/0181627 A1 Jul. 28, 2011

(30) Foreign Application Priority Data

Jan. 22, 2010 (KR) ..... 2010-0005935

(51) Int. Cl.
*G09G 3/30* (2006.01)

(52) U.S. Cl.
USPC ..... 345/77; 345/83; 345/88; 345/89; 313/484; 313/498

(58) Field of Classification Search ..... 345/38, 345/50–54, 60–64, 87–104
See application file for complete search history.

(56) References Cited

U.S. PATENT DOCUMENTS

| | | | | |
|---|---|---|---|---|
| 5,412,737 | A * | 5/1995 | Govrin | 382/168 |
| 5,757,516 | A * | 5/1998 | Naylor, Jr. | 358/463 |
| 6,160,643 | A * | 12/2000 | Deschuytere et al. | 358/504 |
| 6,483,519 | B1 * | 11/2002 | Long et al. | 345/619 |
| 6,529,202 | B2 * | 3/2003 | Wu | 345/593 |
| 7,227,586 | B2 * | 6/2007 | Finlayson et al. | 348/655 |
| 7,268,792 | B2 * | 9/2007 | Lee et al. | 345/694 |
| 8,165,393 | B2 * | 4/2012 | Lu et al. | 382/166 |
| 8,233,733 | B2 * | 7/2012 | Yasuma et al. | 382/254 |
| 2002/0141640 | A1 * | 10/2002 | Kraft | 382/167 |
| 2003/0086606 | A1 * | 5/2003 | Hunter et al. | 382/167 |
| 2005/0047675 | A1 * | 3/2005 | Walmsley et al. | 382/263 |
| 2005/0104840 | A1 * | 5/2005 | Sohn et al. | 345/102 |
| 2005/0212992 | A1 * | 9/2005 | Nakanishi | 349/61 |
| 2008/0144952 | A1 * | 6/2008 | Chen et al. | 382/239 |
| 2009/0135114 | A1 * | 5/2009 | White et al. | 345/78 |
| 2009/0140665 | A1 * | 6/2009 | Park | 315/291 |
| 2009/0141202 | A1 * | 6/2009 | Yoshida | 349/38 |
| 2009/0213048 | A1 * | 8/2009 | Park et al. | 345/77 |
| 2010/0123654 | A1 * | 5/2010 | Kimura | 345/92 |
| 2010/0156884 | A1 * | 6/2010 | Ahn et al. | 345/214 |

FOREIGN PATENT DOCUMENTS

| | | |
|---|---|---|
| JP | 2004-054250 | 2/2004 |
| JP | 2005-148708 | 6/2005 |
| JP | 2005-321424 | 11/2005 |
| JP | 2008-134664 | 6/2008 |

(Continued)

*Primary Examiner* — Amare Mengistu
*Assistant Examiner* — Vinh Lam
(74) *Attorney, Agent, or Firm* — Innovation Counsel LLP

(57) ABSTRACT

A method of controlling a luminance of a light source is presented. The method entails generating red, green, blue and white data using red, green and blue data, applying a color weight according to contribution to luminance by each of the red, green, blue and white data to generate pixel luminance data, setting a luminance level of the light source based on the pixel luminance data, determining local information on a pure color block in a frame image by using the pixel luminance data, and adjusting the luminance level of the light source based on the local information on the pure color block. A display device that utilizes such method is also presented.

19 Claims, 13 Drawing Sheets

FOREIGN PATENT DOCUMENTS

| | | | |
|---|---|---|---|
| KR | 10-2002-0032018 | A | 5/2002 |
| KR | 10-2008-0015679 | A | 2/2008 |
| KR | 10-2008-0016108 | A | 2/2008 |
| KR | 10-2008-0078210 | A | 8/2008 |

* cited by examiner

<HISTOGRAM>

<DISTRIBUTION CHART OF PURE COLOR DATA>

<DISTRIBUTION CHART OF PURE COLOR DATA>

METHOD OF CONTROLLING LUMINANCE OF A LIGHT SOURCE AND DISPLAY APPARATUS FOR PERFORMING THE METHOD

PRIORITY STATEMENT

This application claims priority under 35 U.S.C. §119 to Korean Patent Application No. 2010-5935 filed on Jan. 22, 2010 in the Korean Intellectual Property Office (KIPO), the contents of which are herein incorporated by reference in their entirety.

BACKGROUND OF THE INVENTION

1. Field of the Invention

The present invention relates to a method of controlling a luminance of a light source and a display apparatus for performing the method. More particularly, the present invention relates to a method of controlling a luminance of a light source capable of enhancing display quality of an image having a pure color and a display apparatus for performing the method.

2. Description of the Related Art

Generally, a display apparatus includes a liquid crystal display (LCD) panel displaying an image using light transmittance of liquid crystals and a backlight assembly disposed under the LCD panel to provide light to the LCD panel. The LCD panel has an RGB structure. The RGB structure includes red, green and blue subpixels, and each of the red, green and blue subpixels typically has a rectangular shape.

Recently, a pentile RGBW structure including red, green, blue and white subpixels has been developed. The pentile RGBW structure offers the advantage of using fewer subpixels to achieve the same resolution as the RGB structure. Since the RGBW structure includes the white subpixel, the LCD panel having the RGBW structure has high transmittance. As a result, lower luminance is required of the backlight assembly and power consumption of the display apparatus may be decreased.

However, in the display apparatus having the pentile RGBW structure, a white subpixel in an area on which a pure color image is displayed is turned off and red, green and blue subpixels in the area are turned on for displaying the pure color image that is saturated with colors. Due to the white subpixel being turned off for pure color images, the luminance level is lower for pure color images in a display apparatus incorporating the pentile RGBW structure.

SUMMARY OF THE INVENTION

The present invention provides a method of controlling the luminance level of a light source to improve display quality and decrease power consumption in a display apparatus having red, green, blue and white subpixels.

The present invention also provides a display apparatus for performing the above-mentioned method.

According to one aspect of the present invention, there is provided a method of controlling the luminance of a light source. In the method, red, green, blue and white data are generated using red, green and blue data. A color weight according to contribution to luminance by each of the red, green, blue and white data is applied to generate pixel luminance data. The luminance of the light source is set based on the pixel luminance data. Local information on a pure color block in a frame image is determined using the pixel luminance data. The luminance of the light source is adjusted based on the local information on the pure color block. Local information includes one or more of presence, location, and size of the pure color block.

According to another aspect of the present invention, a display apparatus includes a display panel, a light source part and a data processing circuit. The display panel includes a dot pixel, which has red and green sub pixels or blue and white sub pixels, and displays an image. The light source part provides light to the display panel. The data processing circuit applies a color weight according to contribution to luminance by each of the red, green, blue and white data to generate pixel luminance data, determines local information on a pure color block in the frame image using the pixel luminance data, and adjusts the luminance level of the light source part.

According to the present invention, the luminance of the light source is adjsuted based on the local information on the pure color block comprising the pure color data so that power consumption may be decreased and viewing quality of the pure color block with reference to the background image may be improved.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION OF THE INVENTION

Figure 1:
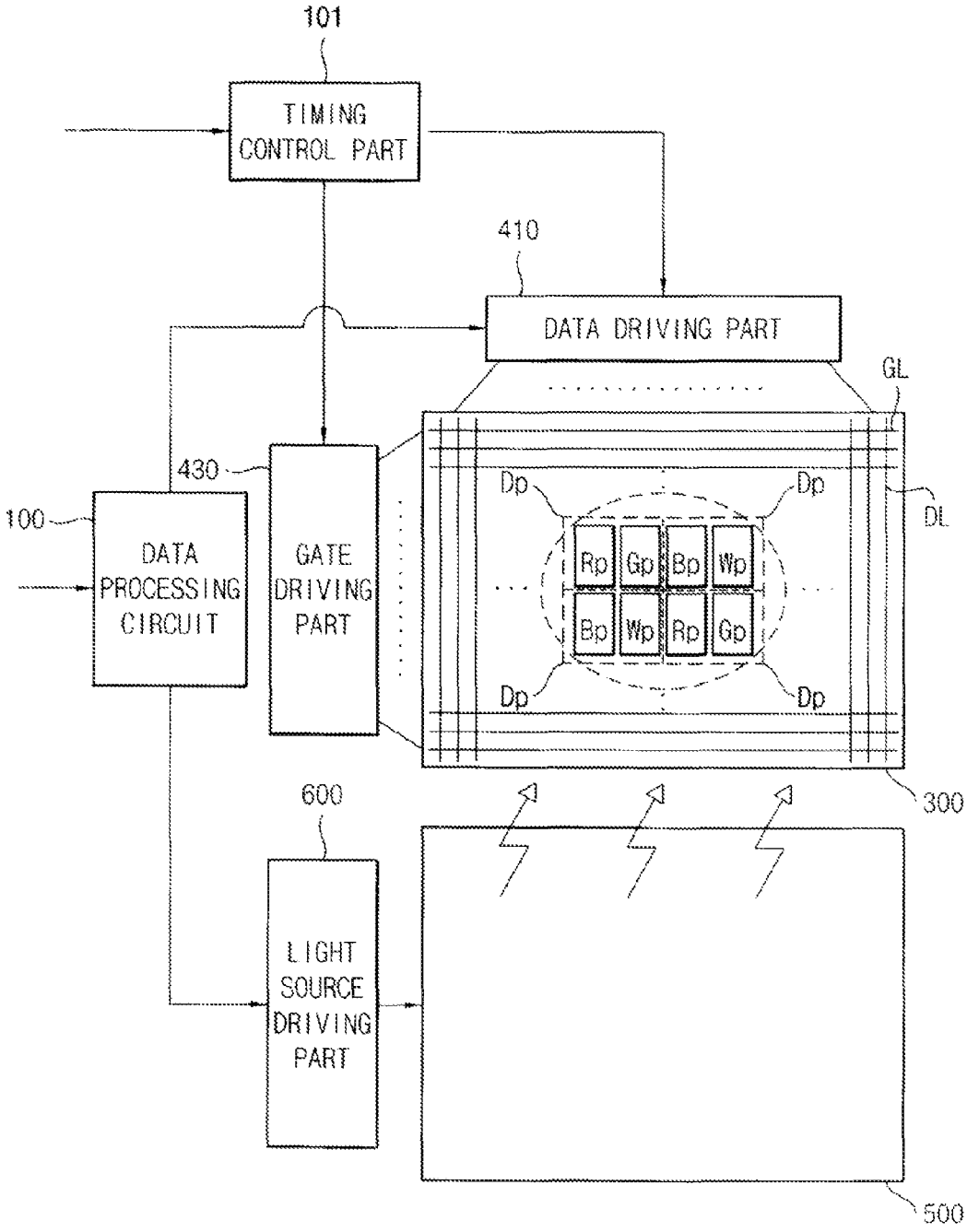
FIG. 1 is a block diagram illustrating a display apparatus according to an example embodiment of the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a block diagram illustrating a display apparatus according to an embodiment of the present invention.

Referring to FIG. 1, the display apparatus includes a timing control part 101, a data processing circuit 100, a display panel 300, a data driving part 410, a gate driving part 430, a light source part 500 and a light source driving part 600.

The timing control part 101 controls the timing for driving the data driver 410 and the gate driver 430 based on a synchronized signal received from outside.

The data processing circuit 100 generates red, green, blue and white data Rro, Gro, Bro and Wro based on red, green and blue data R, G and B received from outside. The data processing circuit 100 determines a luminance that controls a luminance level of the light source part 500 using the red, green and blue data R, G and B.

The display panel 300 has an RGBW structure including red, green, blue and white subpixels Rp, Gp, Bp and Wp. The display panel 300 includes a plurality of data lines DL, a plurality of gate lines GL crossing the data lines DL and a plurality of dot pixels Dp. The dot pixel Dp includes red and green subpixels Rp and Gp or blue and white subpixels Bp and Wp. For example, the size of a dot pixel including red, green and blue subpixels in an RGB matrix is substantially the same as that of the dot pixel of the display panel 300 including red and green subpixels Rp and Gp or blue and white subpixels Bp and Wp.

The data driving part 410 converts the red, green, blue and white data Rro, Gro, Bro and Wro into red, green, blue and white data voltages, and provides the red, green, blue and white data voltages to the data lines.

The gate driving part 430 sequentially provides gate signals to the gate lines GL.

The light source part 500 includes a light source generating light. The light source part 500 provides light to the display panel 300. The light source may include a lamp or a light emitting diode (LED).

The light source driving part 600 generates a driving signal of the light source part 500 using the luminance received from the data processing circuit 100. The driving signal may be a pulse width modulation (PWM).

Figure 2:
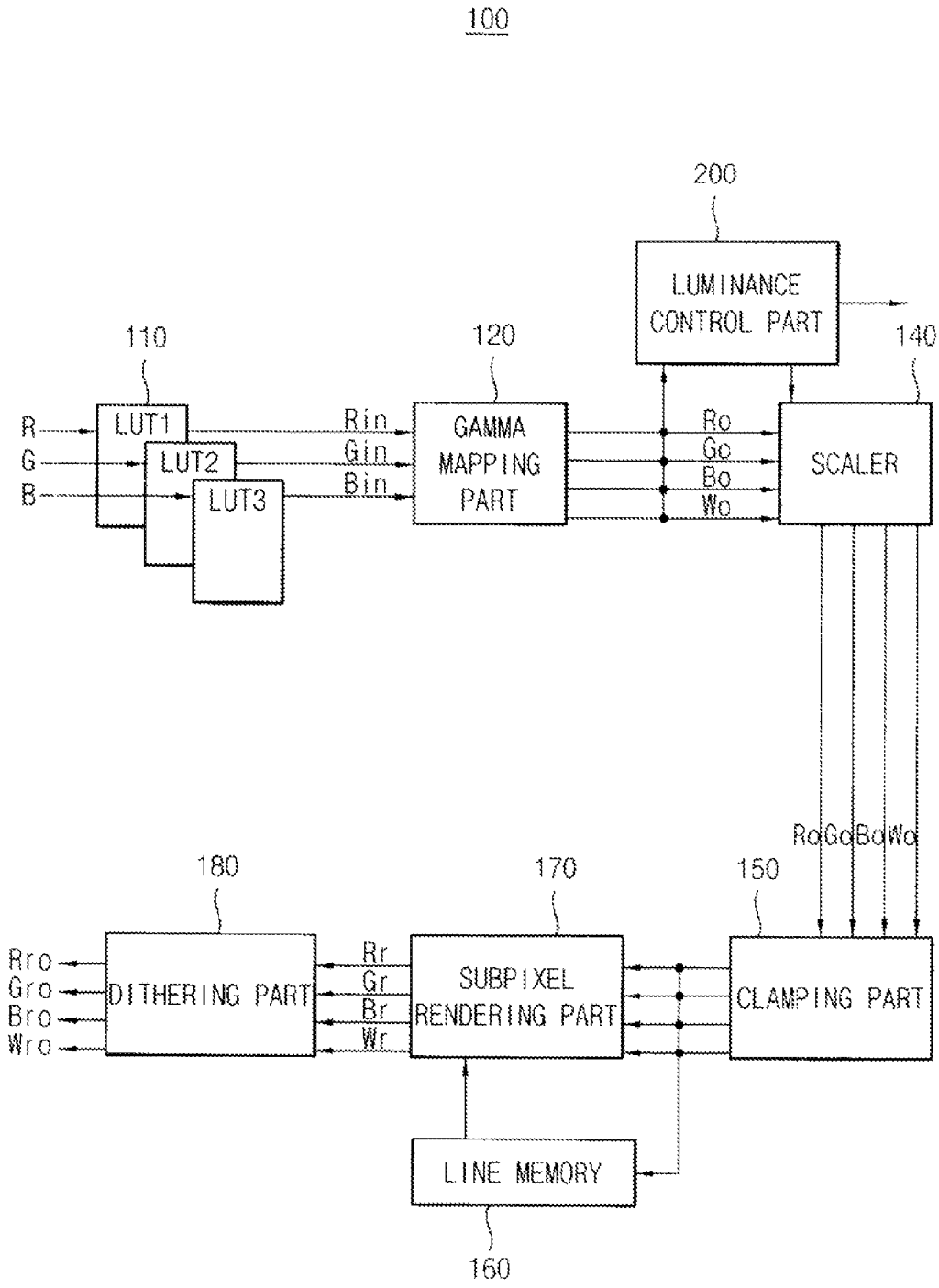
FIG. 2 is a block diagram illustrating a data processing circuit of FIG. 1.

FIG. 2 is a block diagram illustrating a data processing circuit 100 of FIG. 1.

Referring to FIG. 1 and FIG. 2, the data processing circuit 100 includes an input gamma generator 110, a gamma mapping part 120, a luminance control part 200, a scaler 140, a clamping part 150, a line memory 160, a subpixel rendering part 170 and a dithering part 180.

The input gamma generating part 110, which receives c-bit RGB data, includes a red lookup table LUT1, a green lookup table LUT2 and a blue lookup table LUT3. The input gamma generator 110 outputs d-bit red data Rin, d-bit green data Gin and d-bit blue data Bin based on the c-bit red data R, c-bit green data G and c-bit blue data B that are received, by using the red, green and blue lookup tables LUT1, LUT2 and LUT3. Here, c and d are natural numbers and c<d.

The gamma mapping part 120 maps the d-bit red, green and blue data Rin, Gin and Bin on d-bit red, green, blue and white data Ro, Go, Bo and Wo.

The gamma mapping part 120 receives the red, green and blue data Rin, Gin and Bin. The gamma mapping part 120 generates the red, green, blue and white data Ro, Go, Bo and Wo based on the red, green and blue data Rin, Gin and Bin. The gamma mapping part 120 generates the white data Wo.

The gamma mapping part 120 calculates a white ratio WR according to Equation 1.

$$\text{White Ratio}(WR) = \frac{L_W}{L_R + L_G + L_B} = m_2 \quad \text{[Equation 1]}$$

In Equation 1, $L_R$ is a red luminance, $L_G$ is a green luminance, $L_B$ is a blue luminance and $L_W$ is a white luminance.

The gamma mapping part 120 generates the red, green, blue and white data Ro, Go, Bo and Wo based on the white ratio WR according to Equation 2.

$$\begin{aligned} 2Ro &= Rin(1+m_2) - 2m_2Wo \\ 2Go &= Gin(1+m_2) - 2m_2Wo \\ 2Bo &= Bin(1+m_2) - 2m_2Wo \\ 2m_2Wo &= \frac{(2Rin + 5Gin + Bin)}{8}, \\ \max(Rin, Gin, Bin)(1+m_2) - 1 &\le \\ 2m_2Wo &\le \min(Rin, Gin, Bin)(1+m_2) \end{aligned} \quad \text{[Equation 2]}$$

The luminance control part 200 determines the luminance of the light source part 500 using a histogram based on the red, green, blue and white data Ro, Go, Bo and Wo generated in the gamma mapping part 120. The luminance control part 200 adjusts the luminance level according to a distribution of a pure color data included in a frame image. More specifically, the luminance control part 200 preliminarily determines the luminance level of the light source part 500 using the histogram. Then, the luminance control part 200 analyzes local information such as the presence, location and size of a pure color block comprising pure, saturated color data to fine tune the preliminarily-set luminance level.

The scaler 140 corrects grayscales of the red, green, blue and white data Ro, Go, Bo and Wo generated in the gamma mapping part 120 based on the luminance determined in the luminance control part 200. For example, the scaler 140 corrects the grayscales of the red, green, blue and white data Ro, Go, Bo and Wo corresponding to a background image of the frame image to low grayscales that are lower than the grayscales of the pure color block. A "background image," as used herein, refers to image of a frame that is not part of the pure color block. Thus, luminance difference between the pure color block and the background image is increased so that a viewing quality of the pure color block may be improved. The disclosed method of operation is based on the principle that when an image frame contains a pure image and a non-pure image, a greater luminance difference between the two types of images generally improves viewing quality because the increased brightness of the background compensates for the richness and low luminance of the pure color image. In addition, the scaler 140 corrects the grayscales of the background image to the low grayscales to reduce the power consumption of the display apparatus.

The display apparatus has an indoor mode and an outdoor mode that are set by a user. When the display apparatus is in the indoor mode, the scaler may correct the grayscales of the background image to the lower grayscales. When the display apparatus is in the outdoor mode, the scaler 140 applies the grayscales as they are, without alteration.

The clamping part 150 corrects the red, green, blue and white data Ro, Go, Bo and Wo determined in the scaler 140 so that the clamping part 150 corrects a pure color element sacrificed when the light source part 500 is driven with low luminance.

The line memory 160 stores the data output from the clamping part 150. The line memory 160 may store adjacent data, which is the data received before and after a particular set of red, green, blue and white data Ro, Go, Bo and Wo.

The sub pixel rendering part 170 reconstructs the red, green, blue and white data Ro, Go, Bo and Wo to generate red and green data Rr and Gr or blue and white data Br and Wr using the adjacent data stored in the line memory 160 according to a pixel structure of the display panel 300.

The dithering part 180 dithers the red and green data Rr and Gr or the blue and white data Br and Wr which are processed to a d-bit type to output c-bit red and green data Rro and Gro or c-bit blue and white data Bro and Wro.

Figure 3:
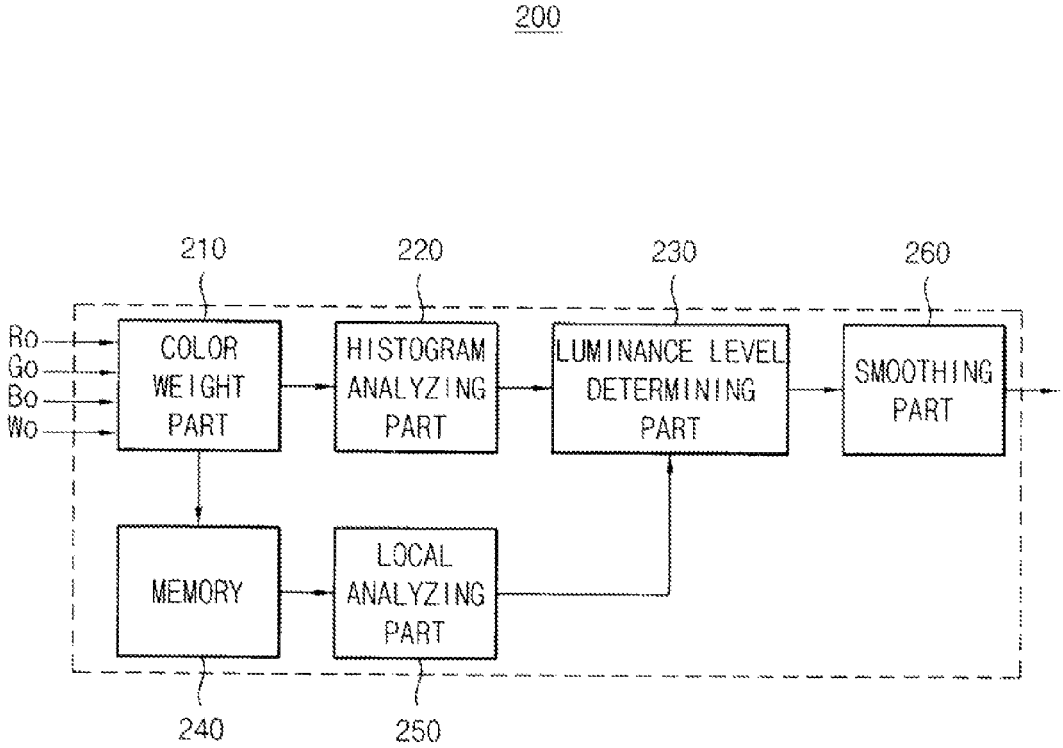
FIG. 3 is a block diagram illustrating a luminance control part of FIG. 2.
Figure 4:
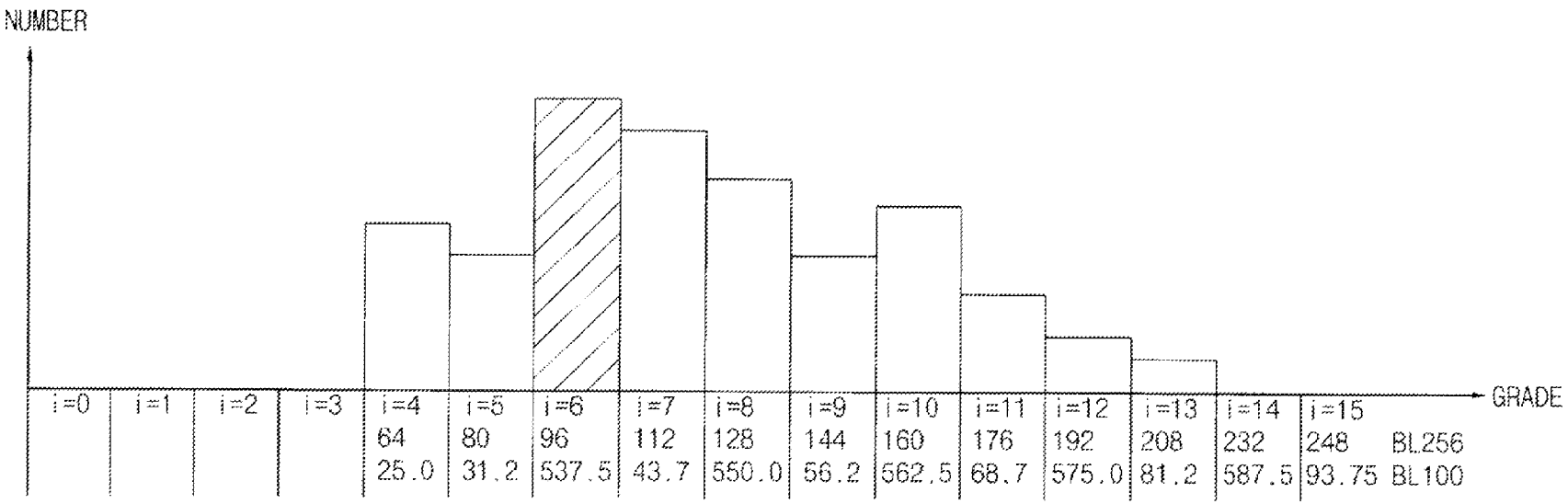
FIG. 4 is a conceptual diagram illustrating a histogram analyzing part of FIG. 3.

FIG. 3 is a block diagram illustrating the luminance control part 200 of FIG. 2. FIG. 4 is a conceptual diagram illustrating a histogram analyzing part 220 of FIG. 3.

Referring to FIG. 2 and FIG. 3, the luminance control part 200 includes a color weight part 210, a histogram analyzing part 220, a luminance determining part 230, a memory 240, a local analyzing part 250 and a smoothing part 260.

The color weight part 210 receives the red, green, blue and white data Ro, Go, Bo and Wo. The color weight part 210 applies a red weight RWT, a green weight GWT, a blue weight BWT and white weight WWT to the red, green, blue and white data Ro, Go, Bo and Wo so as to generate a pixel luminance data PLD. The red, green, blue and white weights RWT, GWT, BWT and WWT are set according to each of their degree of contribution to luminance.

The red, green, blue and white weights RWT, GWT, BWT and WWT may be defined according to Equation 3.

$$\begin{aligned} R_L &= R_o \times \left(RWT + (YWT - RWT) \times \frac{G_o}{256}\right), \\ &\text{where } YWT \ge RWT \\ G_L &= G_o \times GWT \\ B_L &= B_o \times BWT \\ W_L &= W_o \times WWT \\ PLD &= \text{Max}(R_L, G_L, B_L, W_L,) \end{aligned} \quad \text{[Equation 3]}$$

In Equation 3, each of the red, green, blue and white data Ro, Go, Bo and Wo of Equation 3 is data of 8 bits. The color weight part 210 normalizes the pixel luminance data PLD according to Equation 3. For example, the color weight part 210 normalizes the pixel luminance data PLD to 8-bit data.

The histogram analyzing part 220 generates a histogram. The histogram is a frequency distribution. As shown in FIG. 4, the x axis of the histogram includes i (wherein, i is natural number) bins that are divided according to levels of the pixel luminance data PLD and the y axis of the histogram includes a number of the pixel luminance data PLD included in each of the i bins.

Referring to FIG. 4, when the pixel luminance data PLD is 8-bit data, the levels of the pixel luminance data PLD are 1 to 256 and the histogram analyzing part 220 divides the levels of the pixel luminance data PLD into i (e.g., i=15) bins. The histogram analyzing part 220 receives the pixel luminance data PLD and counts the number of the pixel luminance data PLD in each of the bins to generate the histogram.

The luminance determining part 230 determines the luminance of the light source part 500 corresponding to a present frame using the histogram. Referring to FIG. 4, the luminance determining part 230 determines that the present frame is the most pixel luminance data PLD included in a sixth grade and determines the luminance of the light source part 500 to be '96' (based on 8 bits) corresponding to the sixth grade.

The memory 240 stores the pixel luminance data PLD received from the color weight part 210. The memory 240 has a size capable of storing the pixel luminance data corresponding to a plurality of horizontal lines.

The local analyzing part 250 analyzes the local information including the location and size of the pure color block in which the pure color data is continuously arranged using the pixel luminance data PLD stored in the memory 240.

For example, the local analyzing part 250 determines the pixel luminance data PLD as the pure color data, when the pixel luminance data PLD is more than a pure color reference value and analyzes the local information on the pure color block comprising the pure color data.

The luminance determining part 230 adjusts the luminance based on the local information on the pure color block received from the local analyzing part 250. For example, when the size of the pure color block exceeds a reference size, the luminance determining part 230 may determine the luminance as the maximum luminance. When a white subpixel of the pure color block is turned off and red, green and blue subpixels of the pure color block are turned on, the pure color block may be displayed on the display panel 300. Thus, the luminance of the pure color block displayed on the display panel 300 may be low. Particularly, when one pure color block is displayed on a center of the display panel 300, the luminance difference between the background image and the pure color block is decreased so that the viewing quality of the pure color block is also compromised.

Therefore, when there is a single pure color block in the frame image and the size of the pure color block exceeds the reference size, the light source part 500 is driven to have the maximum luminance to compensate for the decrease in luminance due to the RGBW structure of the display panel 300. Thus, the luminance determining part 230 determines the luminance of the light source part 500 as the maximum luminance when the size of the pure color block exceeds the reference size.

When a frame image includes a plurality of pure color blocks, the luminance determining part 230 determines the luminance of the light source part 500 as a luminance lower than the maximum luminance. When pure color blocks are displayed on the display panel 300, the luminance difference between the background image and the pure color blocks is smaller than the luminance difference of one pure color block. Thus, though a total size of the pure color blocks in the frame image is more than the reference value, the luminance determining part 230 determines the luminance of the light source part 500 as the luminance lower than the maximum luminance.

For example, when the total size of four pure color blocks in the frame image exceeds the reference size, the luminance determining part 230 sets the luminance level at a first level that is lower than the maximum luminance level. In addition, when there are eight pure color blocks in the frame image whose cumulative size adds up to more than the reference size, the luminance determining part 230 sets the luminance level at a level that is two levels lower than the maximum luminance level. Therefore, when a frame image includes pure color blocks, the luminance difference between the background image and the pure color blocks is smaller than when the frame image includes one large pure color block. The luminance determining part 230 selects a luminance level that is lower than the maximum luminance level when there are multiple pure color blocks. Thus, the power consumption of the display apparatus may be reduced.

The smoothing part 260 smoothly adjusts a difference between the luminance determined in the present frame and a luminance determined in a previous frame. For example, when the luminance determined in the previous frame is '64' (based on 8 bits) and the luminance determined in the present frame is '255' (based on 8 bits), the smoothing part 260 smoothly adjusts the difference between the luminance '255' of the present frame and the luminance '64' of the previous frame to correct the luminance of the present frame to be at a level between 255 and 64, e.g. 170 (based on 8 bits). This smoothing function improves the viewing quality.

Figure 5:
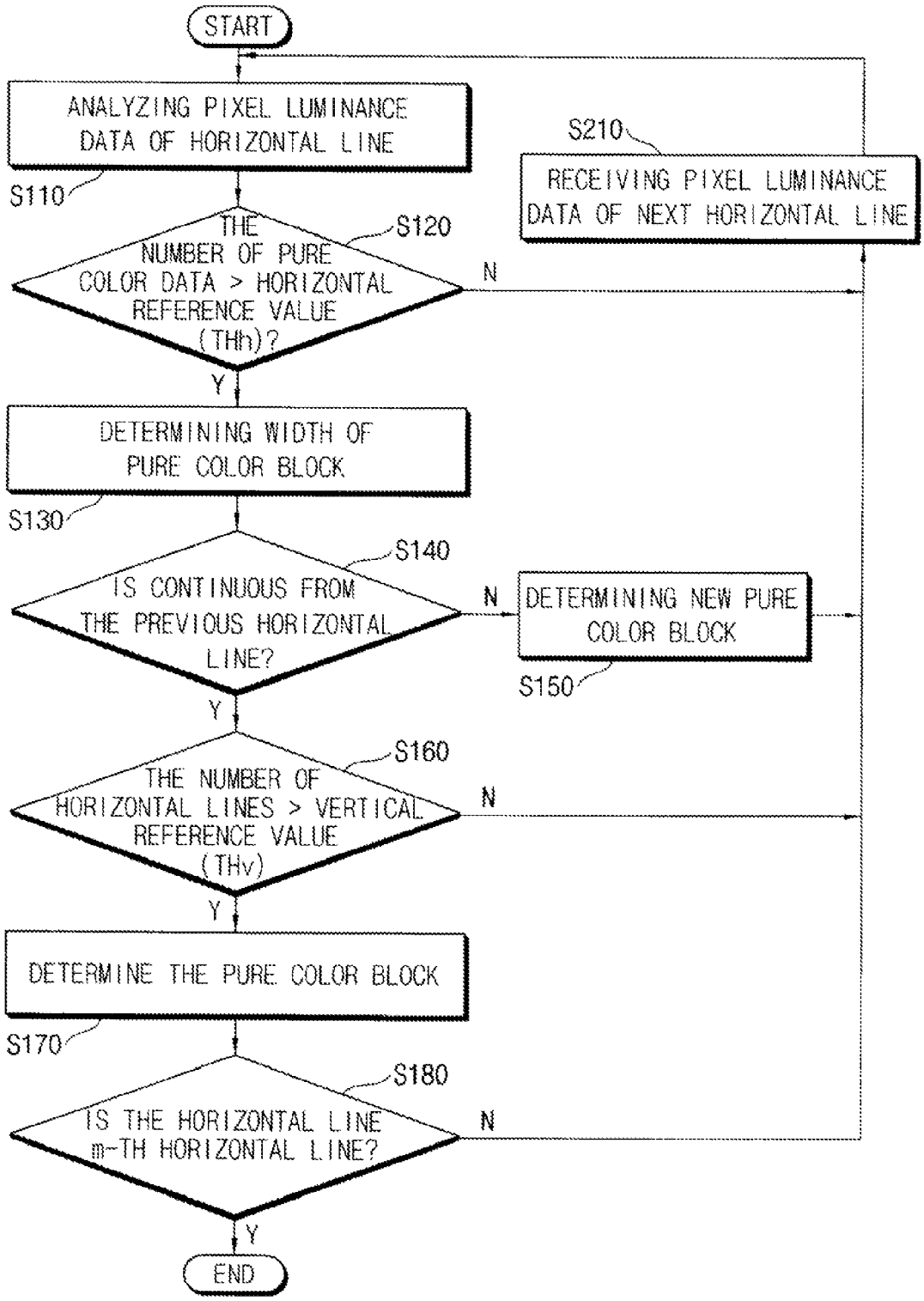
FIG. 5 is a flowchart diagram illustrating a method of operating a local analyzing part of FIG. 3.
Figure 6A:
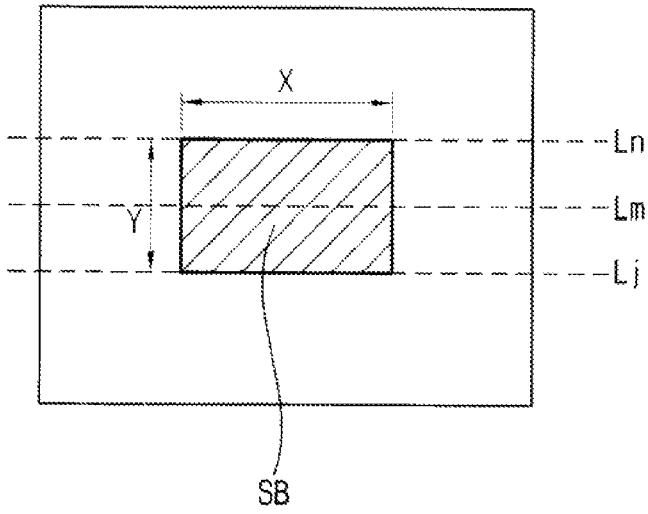
FIGS. 6A and 6B are conceptual diagrams illustrating a frame image including one pure color block.
Figure 6B:
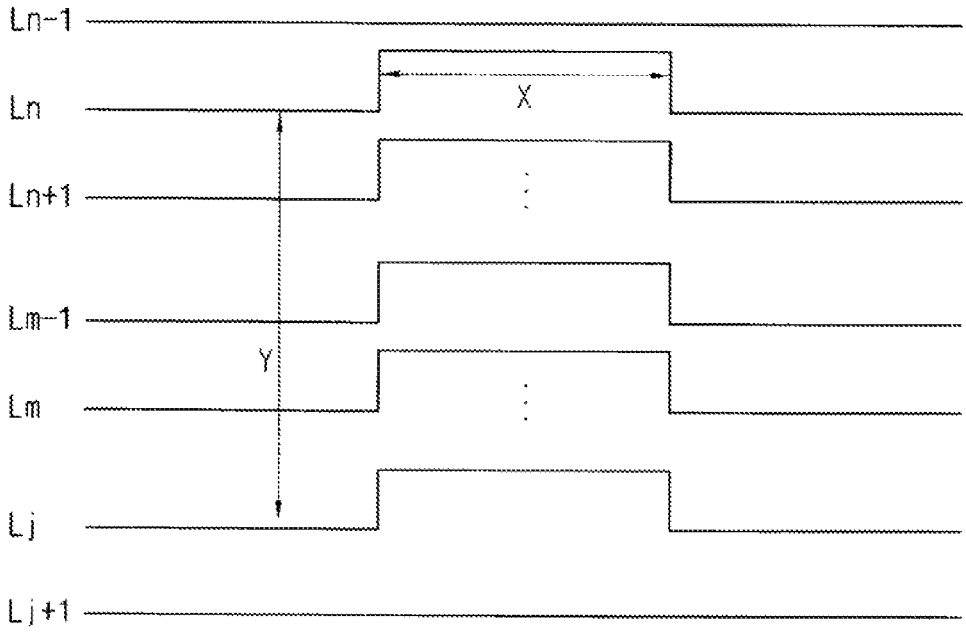

FIG. 5 is a flowchart diagram illustrating a method of operating a local analyzing part 250 of FIG. 3. FIGS. 6A and 6B are conceptual diagrams illustrating a frame image including one pure color block.

Referring to FIG. 5, FIG. 6A and FIG. 6B, the frame image has a resolution of N×M. The local analyzing part 250 determines whether the pixel luminance data PLD stored in the memory 240 is pure color data and analyzes the local information on the pure color block SB in the frame image using the pixel luminance data PLD stored in the memory 240.

Referring to FIG. 6A and FIG. 6B, the local analyzing part 250 compares the pure color reference value with the pixel luminance data included in a first horizontal line to an (n−1)-th horizontal line so that the pixel luminance data that is more than the pure color reference value is not in the first horizontal line to the (n−1)-th horizontal line (wherein, n is a natural number). When this condition is fulfilled, the local analyzing part 250 concludes that the pure color block is not in the first horizontal line to the (n−1)-th horizontal line.

The local analyzing part 250 moves on to the n-th line Ln and compares the pixel luminance data included in an n-th horizontal line Ln with the pure color reference value and analyzes whether pure color data is included in the n-th horizontal line Ln. In addition, the local analyzing part 250 analyzes whether the pure color data of the n-th horizontal line Ln is continuously arranged in neighboring lines (step S110).

When a number of the pure color data that is continuously arranged in the n-th horizontal line Ln is more than a horizontal reference value THh (step S120), the local analyzing part 250 determines the pure color block SB to have a width X shown in FIG. 6A (step S130). However, when the number of the pure color data is less than the horizontal reference value THh, the local analyzing part 250 receives a next horizontal line, that is, the pixel luminance data of an (n+1)-th horizontal line (step S210).

After the width X of the pure color block SB is determined, the local analyzing part 250 analyzes whether the pure color data in the n-th horizontal line Ln is continuously arranged with the pure color data in the (n−1)-th horizontal line Ln−1 (step S140). In step S140, when it is checked that the pure color data in the n-th horizontal line Ln is not continuously arranged with the pure color data in the (n−1)-th horizontal line Ln−1, the local analyzing part 250 analyzes that a new pure color block SB is started (step S150). Therefore, the local analyzing part 250 determines that the pure color block SB starts at the n-th horizontal line Ln. The local analyzing part 250 receives a next horizontal line, that is, the pixel luminance data of an (n+2)-th horizontal line (step S210).

The local analyzing part 250 repeats step S110 to step S130 to determine the width X of the pure color block SB using the number of the pure color data included in the (n+1)-th horizontal line Ln+1.

In step S140, the local analyzing part 250 analyzes whether the pure color data included in the (n+1)-th horizontal line Ln+1 is continuously arranged with the pure color data included in the n-th horizontal line Ln. When the pure color data included in the (n+1)-th horizontal line Ln+1 is continuously arranged with the pure color data included in the n-th horizontal line Ln, the local analyzing part 250 analyzes whether the number of horizontal lines that include the pure color data of the continuously arranged block is more than a vertical reference value THv (step S160).

When the number of the horizontal lines is less than the vertical reference value THv, the local analyzing part 250 receives a next horizontal line, that is, the pixel luminance data of the (n+2)-th horizontal line (step S210).

The local analyzing part 250 repeats step S110 to step S140 and step S210 until the pixel luminance data of a horizontal line corresponding to the vertical reference value THv is received.

Thereafter, the local analyzing part 250 analyzes the pixel luminance data of an m-th horizontal line Lm to determine the width of the pure color block SB corresponding to the m-th horizontal line Lm (step S110 to the step S130). Herein, m is a natural number.

In the step S140, the local analyzing part 250 analyzes whether the pure color data included in the m-th horizontal line Lm is continuously arranged with the pure color data included in a (m−1)-th horizontal line Lm−1. When the pure color data included in the m-th horizontal line Lm is continuously arranged with the pure color data included in a (m−1)-th horizontal line Lm−1m, the local analyzing part 250 compares the number of the horizontal lines, that is, the number (m−n) of the horizontal lines to the m-th horizontal line Lm from the n-th horizontal line Ln with the vertical reference value THv (step S170). When the number (m−n) is the same as the vertical reference value THv, the local analyzing part 250 may determine the number (m−n) to be the height of the pure color block SB (step S170).

Then, the local analyzing part 250 analyzes whether the m-th horizontal line Lm is the last horizontal line that is an m-th horizontal line (step S180). As used herein, m is a natural number. When the m-th horizontal line Lm is not the last horizontal line, the local analyzing part 250 receives the pixel luminance data of a next horizontal line (step S210).

The local analyzing part 250 determines the height of the pure color block SB as 'Y' using the pixel luminance data of the (m+1)-th to a j-th horizontal line. Herein, j is a natural number. The local analyzing part 250 then analyzes the pixel luminance data of the m-th horizontal line to obtain the local information on the pure color block SB in the frame image.

Figure 7A:
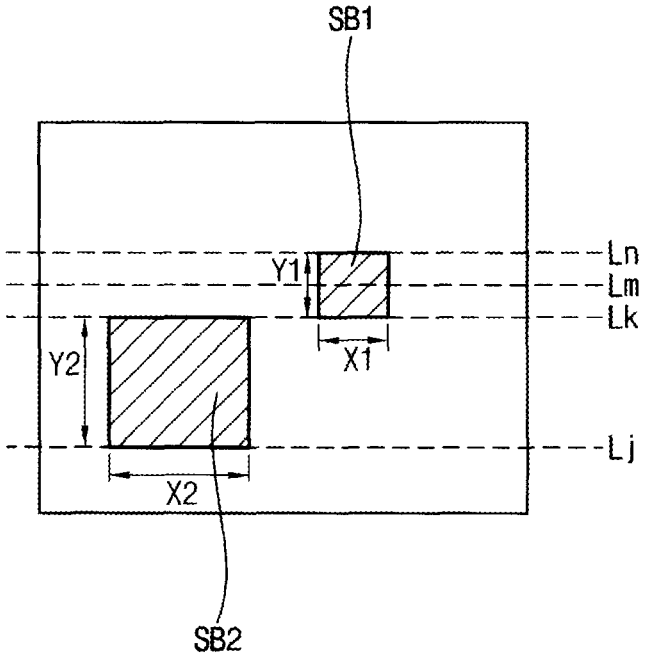
FIGS. 7A and 7B are conceptual diagrams illustrating a frame image including a plurality of pure color blocks.
Figure 7B:
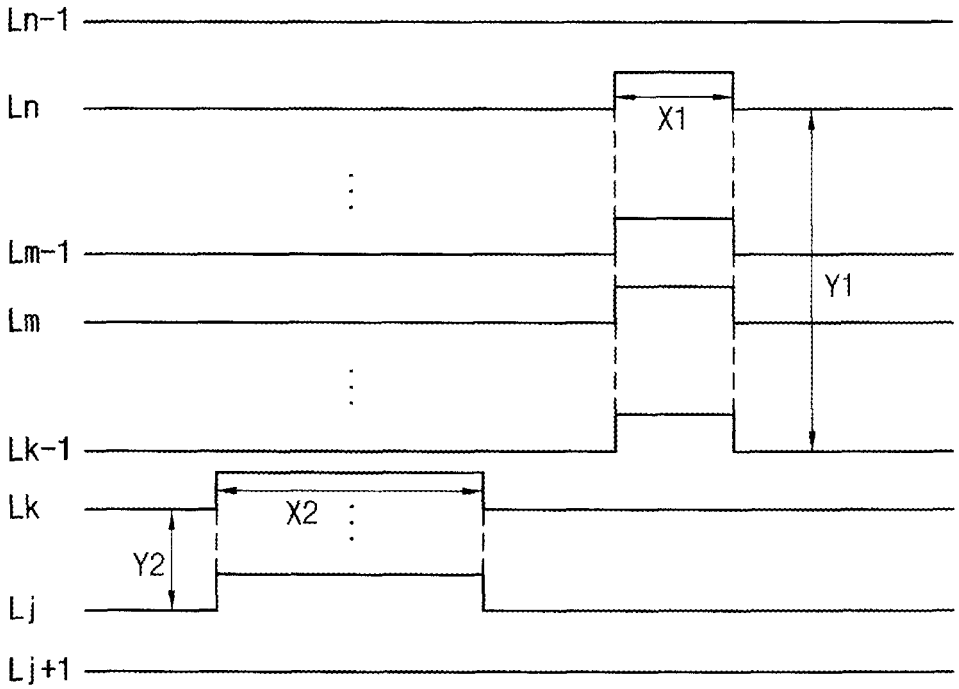

FIGS. 7A and 7B are conceptual diagrams illustrating a frame image including a plurality of pure color blocks.

Referring to FIGS. 5, 7A and 7B, the local analyzing part 250 compares the pure color reference value with each of the pixel luminance data of a first horizontal line to an (n−1)-th horizontal line and thus the pixel luminance data that is more than the pure color reference value is not in the first horizontal line to the (n−1)-th horizontal line. The local analyzing part 250 determines that the pure color data is not in the first horizontal line to the (n−1)-th horizontal line.

The local analyzing part 250 determines that the location at which a first pure color block SB1 having a first width X1 starts is the n-th horizontal line Ln by analyzing the pixel luminance data of the (n−1)-th horizontal line Ln−1 and the n-th horizontal line Ln.

The local analyzing part 250 determines that the location at which a second pure color block SB2 having a second width X2 starts is the k-th horizontal line Lk (wherein k is a natural number) by analyzing the pixel luminance data of the (k−1)-th horizontal line Lk−1 and the k-th horizontal line Lk. In addition, the local analyzing part 250 determines that the first pure color block SB1 is continuously arranged to the m-th horizontal line Lm.

The local analyzing part 250 determines that the height of the first pure color block SB1 is a first height Y1 by analyzing the pixel luminance data of the k-th horizontal line Lk and a (k+1)-th horizontal line Lk+1. The local analyzing part 250 determines that the second pure color block SB2 starts at the k-th horizontal line Lk by analyzing the pixel luminance data of the k−1th horizontal line Lk−1 and a-th horizontal line Lk.

The local analyzing part 250 determines the height of the second pure color block SB2 to be a second height Y2 by analyzing the pixel luminance data of the j-th horizontal line Lj and a (j+1)-th horizontal line Lj+1.

This way, the local analyzing part 250 may obtain the local information on the first and second pure color blocks SB1 and SB2 in the frame image.

Figure 8A:
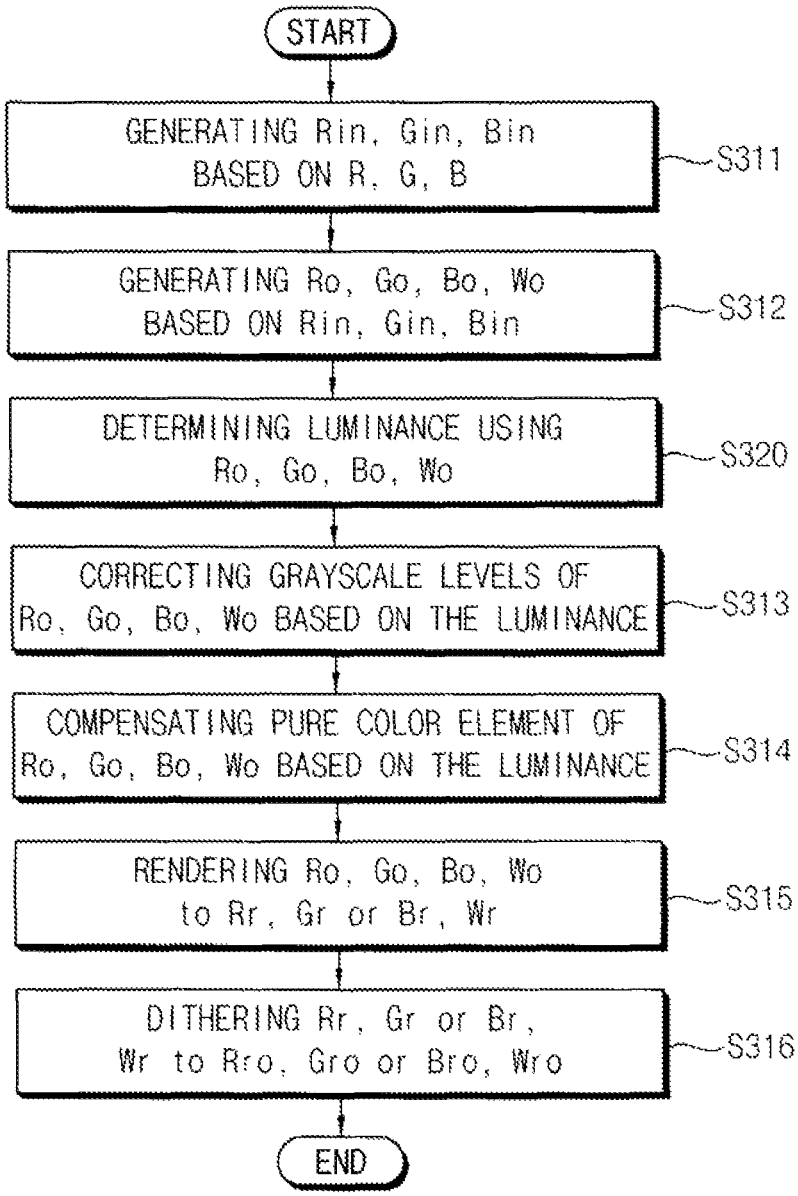
FIGS. 8A and 8B are flowchart diagrams illustrating a method of driving the display apparatus of FIG. 1.
Figure 8B:
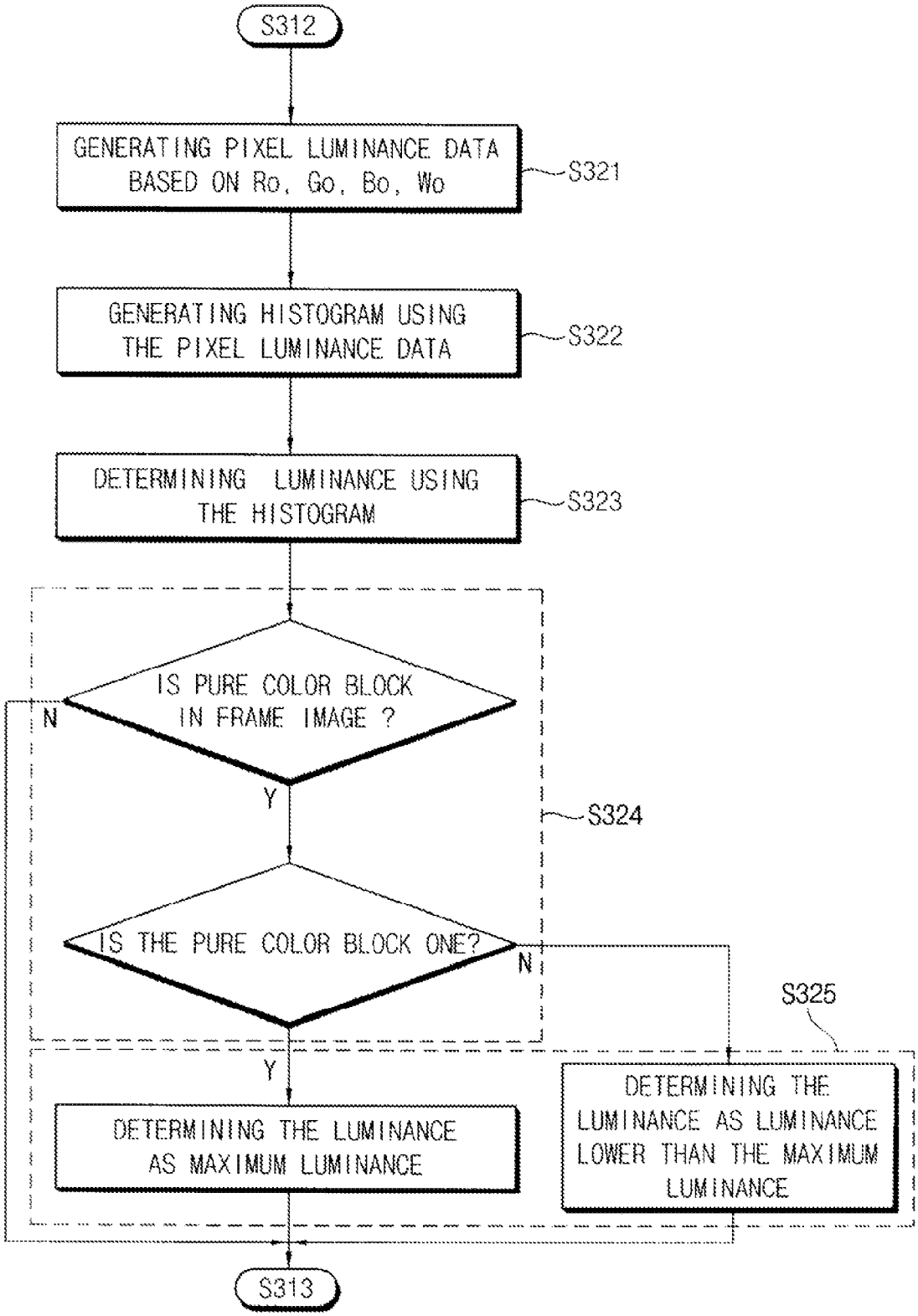

FIGS. 8A and 8B are flowchart diagrams illustrating a method of driving a display apparatus of FIG. 1.

Referring to FIG. 1, FIG. 2, FIG. 3, FIG. 8A and FIG. 8B, the input gamma generating part 110 outputs d-bit red data Rin, d-bit green data Gin and d-bit blue data Bin based on the c-bit red data R, c-bit green data G and c-bit blue data B using the red, green and blue lookup tables LUT1, LUT2 and LUT3 (step S311).

The gamma mapping part 120 maps the d-bit red, green and blue data Rin, Gin and Bin on d-bit red, green, blue and white data Ro, Go, Bo and Wo (step S312).

The luminance control part 200 determines the luminance level of the light source part 500 using the histogram based on the red, green, blue and white data Ro, Go, Bo and Wo generated in the gamma mapping part 120 (step S320).

For example, the color weight part 210 receives the red, green, blue and white data Ro, Go, Bo and Wo, and applies a red weight RWT, a green weight GWT, a blue weight BWT and white weight WWT to the red, green, blue and white data Ro, Go, Bo and Wo so as to generate a pixel luminance data PLD (step S321). The red, green, blue and white weights RWT, GWT, BWT and WWT are set according to each color's degree of contribution to luminance.

The histogram analyzing part 220 generates the histogram that includes i bins dividing total levels of the pixel luminance data PLD on the x axis and the number of the pixel luminance data PLD corresponding to each of the i bins on the y axis (step S322).

The luminance determining part 230 determines and selects the luminance level of the light source part 500 corresponding to a present frame using the histogram (step S323).

The local analyzing part 250 analyzes the local information including the location and size of the pure color block in which the pure color data is continuously arranged using the pixel luminance data PLD stored in the memory 240 (step S324).

The luminance determining part 230 adjusts the luminance level based on the local information on the pure color block received from the local analyzing part 250 (step S325). For example, when one pure image block in the frame image is larger than the reference size, the luminance determining part 230 preliminarily sets the luminance at a maximum luminance level. When the total size of four pure color blocks in the frame image adds up to more than the reference size, the luminance determining part 230 adjusts the luminance level so that it is one level lower than the maximum luminance level. When the total size of eight pure color blocks in the frame image exceeds the reference size, the luminance determining part 230 sets the luminance level at two levels lower than the maximum luminance level. Generally, when the frame image includes multiple pure color blocks, the luminance level of the light source part 500 is decreased so that the power consumption of the display apparatus may be reduced.

The smoothing part 260 corrects the luminance determined in the present frame so that a difference between the luminance determined in the present frame and a luminance determined in the previous frame is smooth, as described above.

The scaler 140 corrects grayscales of the red, green, blue and white data Ro, Go, Bo and Wo generated in the gamma mapping part 120 based on the luminance determined in the luminance control part 200 (step S313). For example, when the frame image includes the pure color block, the scaler 140 corrects the grayscales of the background image to low grayscales so that the luminance difference between the background image and the pure color block may be increased.

The clamping part 150 compensates for the pure color element that is sacrificed when the light source part 500 is driven with the low luminance (step S314). The "clamping" technology is well known.

The sub pixel rendering part 170 reconstructs the red, green, blue and white data Ro, Go, Bo and Wo to generate red and green data Rr and Gr or blue and white data Br and Wr using the adjacent data adjacent to the red, green, blue and white data Ro, Go, Bo and Wo stored in the line memory 160 according to a pixel structure of the display panel 300 (step S315).

The dithering part 180 dithers the red and green data Rr and Gr or the blue and white data Br and Wr which are processed to a d-bit type to output c-bit red and green data Rro and Gro or c-bit blue and white data Bro and Wro (step S316).

Hereinafter, the same reference numerals will be used to refer to the same or like parts as those described in the previous embodiment, and any repetitive detailed explanation will be omitted.

Figure 9:
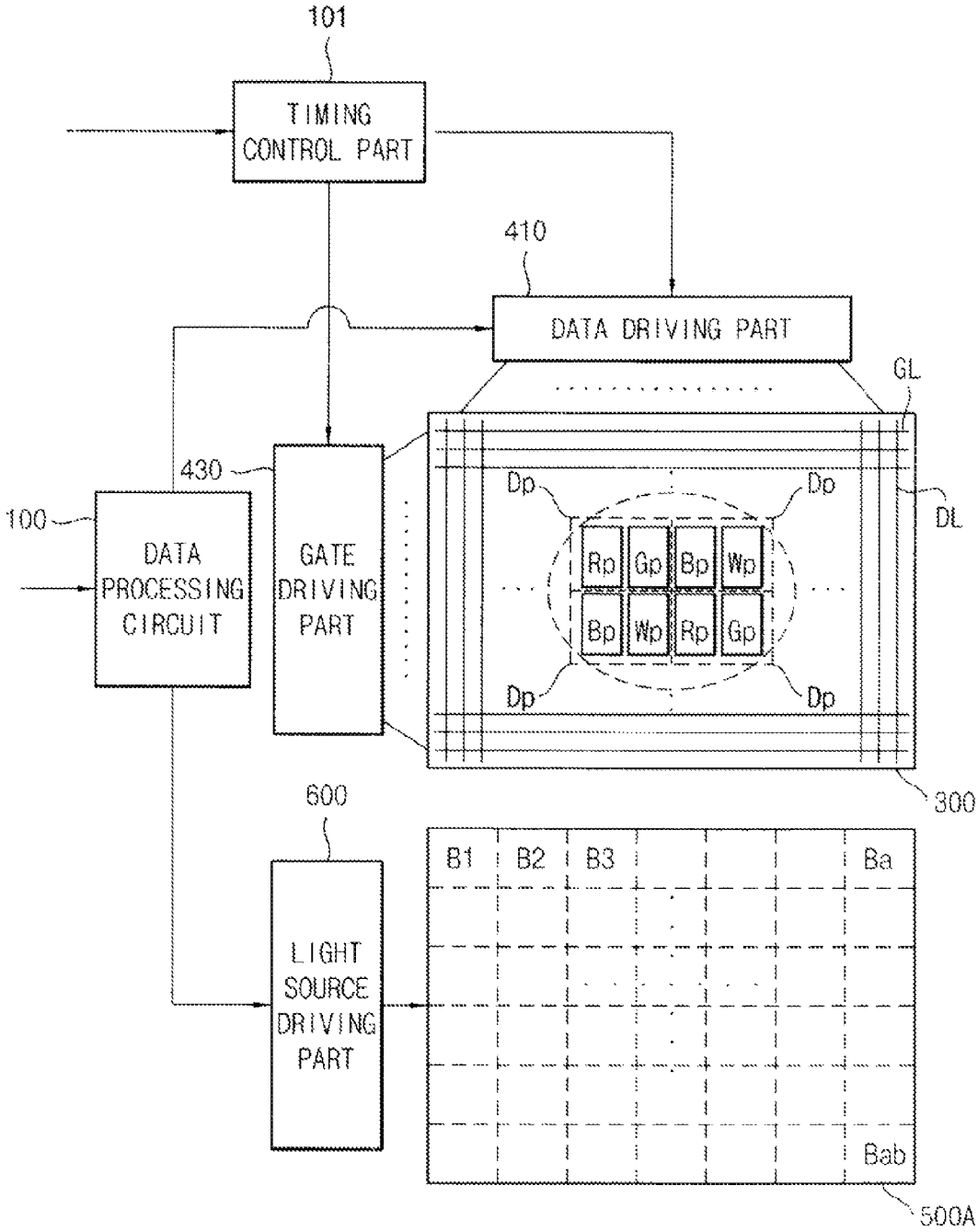
FIG. 9 is a block diagram illustrating a display apparatus according to another example embodiment of the present invention.

FIG. 9 is a block diagram illustrating a display apparatus according to another example embodiment of the present invention.

Referring to FIG. 9, the display apparatus includes a timing control part 101, a data processing circuit 100, a display panel 300, a data driving part 410, a gate driving part 430, a light source part 500A and a light source driving part 600.

The light source part 500A includes a plurality of light-emitting blocks B1, B2, B3, . . . , Bab. The light-emitting blocks B1, B2, B3, . . . , Bab may be individually driven. For example, when the pure color block comprising pure color data is included in the frame image displayed on the display panel 300, a light-emitting block corresponding to an area where the pure color block is displayed may be driven with a brighter luminance than the light-emitting block corresponding to an area where the background image is displayed. Thus, the luminance difference between the pure color block and the background image may be increased, improving viewing quality.

Figure 10:
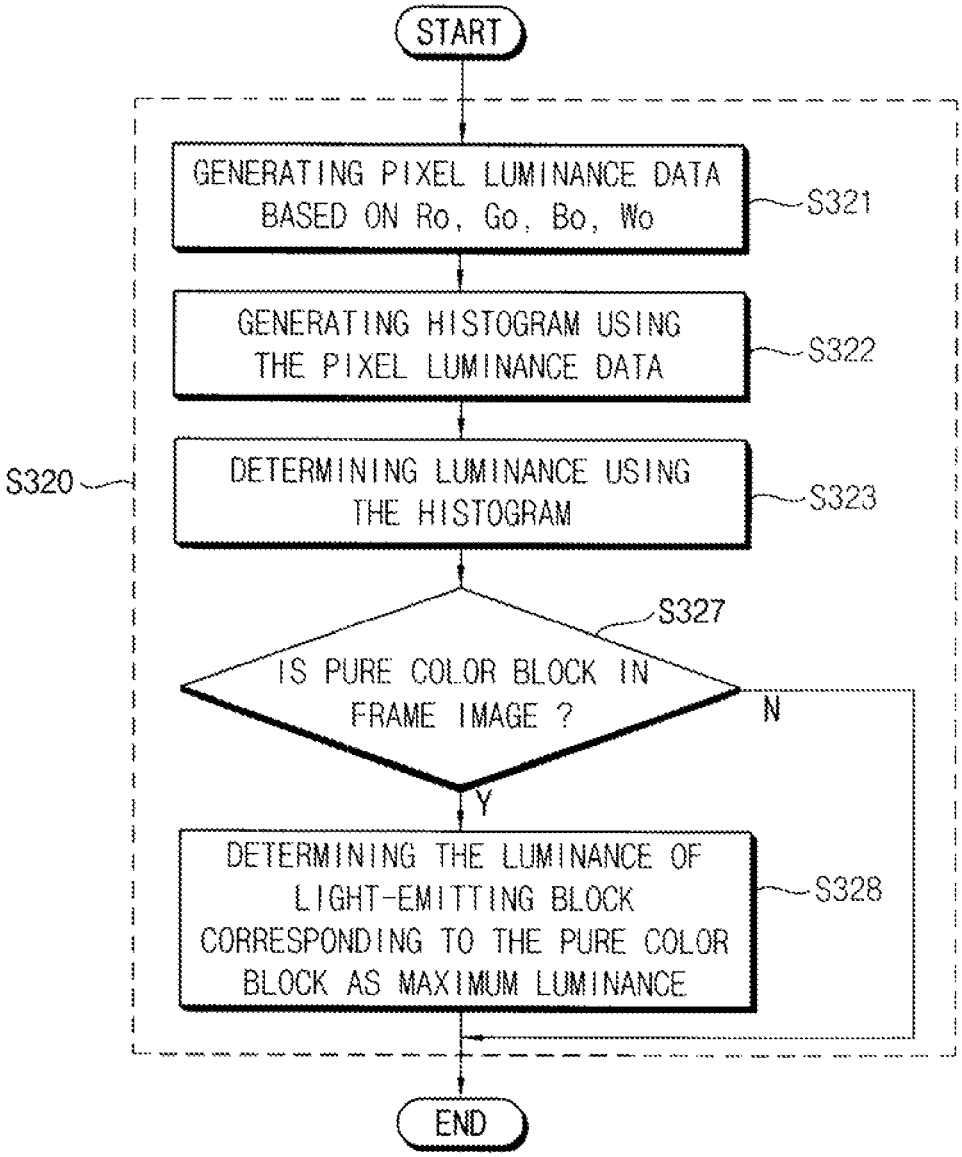
FIG. 10 is a flowchart diagram illustrating a method of controlling a light source according to the display apparatus of FIG. 9.

FIG. 10 is a flowchart diagram illustrating a method of controlling a light source according to the display apparatus of FIG. 9. In comparison with the method of driving the display apparatus described in the previous embodiment referring to FIG. 8A, a method of driving display apparatus according to the present embodiment is substantially the same as the method of the previous embodiment, with a primary difference being determining the luminance level of the light source in the step S320. Hereinafter, a method of determining the luminance level of the light source according to the present embodiment will be explained in detail with reference to the accompanying drawings.

Referring to FIG. 9 and FIG. 10, the luminance control part 200 determines a luminance of the light source part 500 using the histogram based on the red, green, blue and white data Ro, Go, Bo and Wo generated in the gamma mapping part 120 (step S320).

For example, the color weight part 210 receives the red, green, blue and white data Ro, Go, Bo and Wo and applies a red weight RWT, a green weight GWT, a blue weight BWT and a white weight WWT to the red, green, blue and white data Ro, Go, Bo and Wo to generate a pixel luminance data PLD (step S321). The red, green, blue and white weights RWT, GWT, BWT and WWT are set according to each color's degree of contribution to luminance.

The histogram analyzing part 220 generates the histogram that includes i bins on the x axis. Each bin represents a sub-range of the entire range of the pixel luminance data PLD. The y-axis represents the number of the pixel luminance data PLD corresponding to each of the i bins (step S322).

The luminance determining part 230 determines the luminance level of the light source part 500 corresponding to the present frame using the histogram (step S323).

The local analyzing part 250 analyzes the local information including the location and the size of the pure color block in which the pure color data is continuously arranged using the pixel luminance data PLD stored in the memory 240 (step S324).

According to a result obtained by the local analyzing part 250, when the frame image includes the pure color block SB, the luminance determining part 230 redetermines or adjusts the luminance level of a first light-emitting block corresponding to an area on which the pure color block SB is displayed. Specifically, the local analyzing part 250 adjusts the luminance level of the first light-emitting block to be higher than the luminance level of a second light-emitting block corresponding to an area on which the background image is displayed (step S328). For example, the luminance of the first light-emitting block is redetermined as the maximum luminance (step S328), and the luminance of the second light-emitting block is redetermined as the luminance level that was set in step S323. This way, the light-emitting blocks B1, B2, B3, . . . , Bab of the light source part 500A are individually driven so that power consumption of the display apparatus may be reduced and the viewing quality of the pure color block SB with reference to the background image may be improved.

Figure 11A:
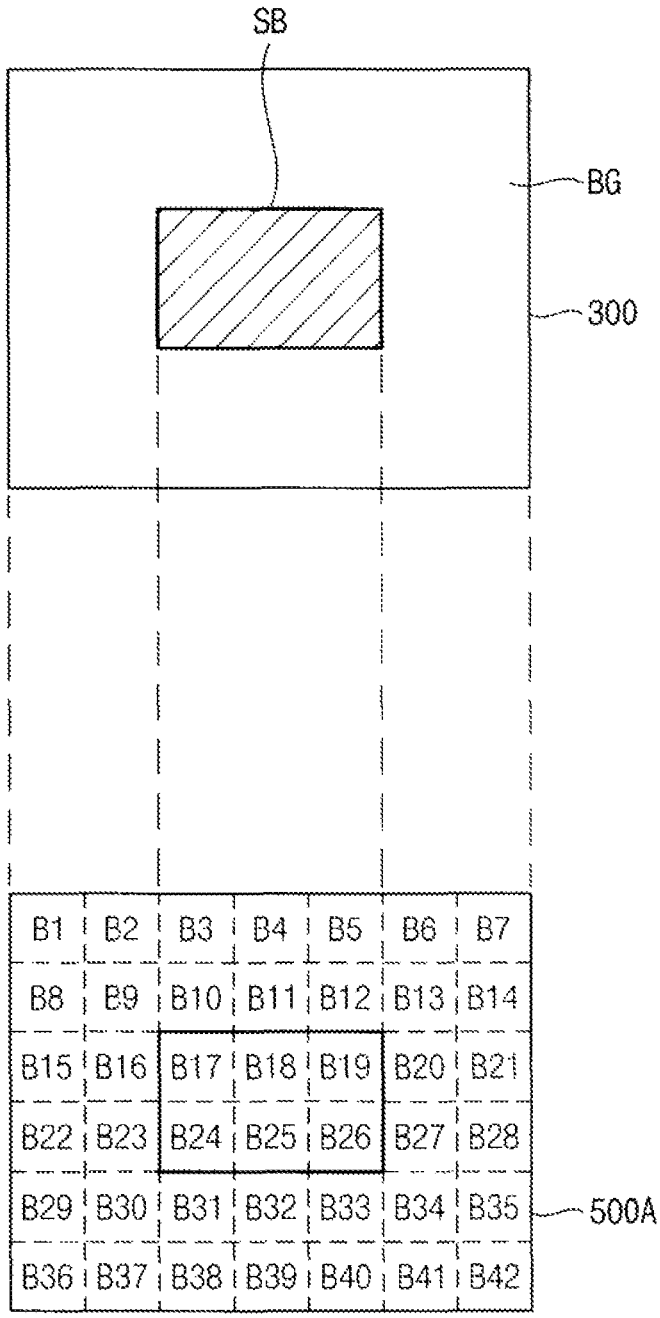
FIGS. 11A and 11B are conceptual diagrams illustrating a method of driving a light source part according to the method of controlling the light source of FIG. 10.
Figure 11B:
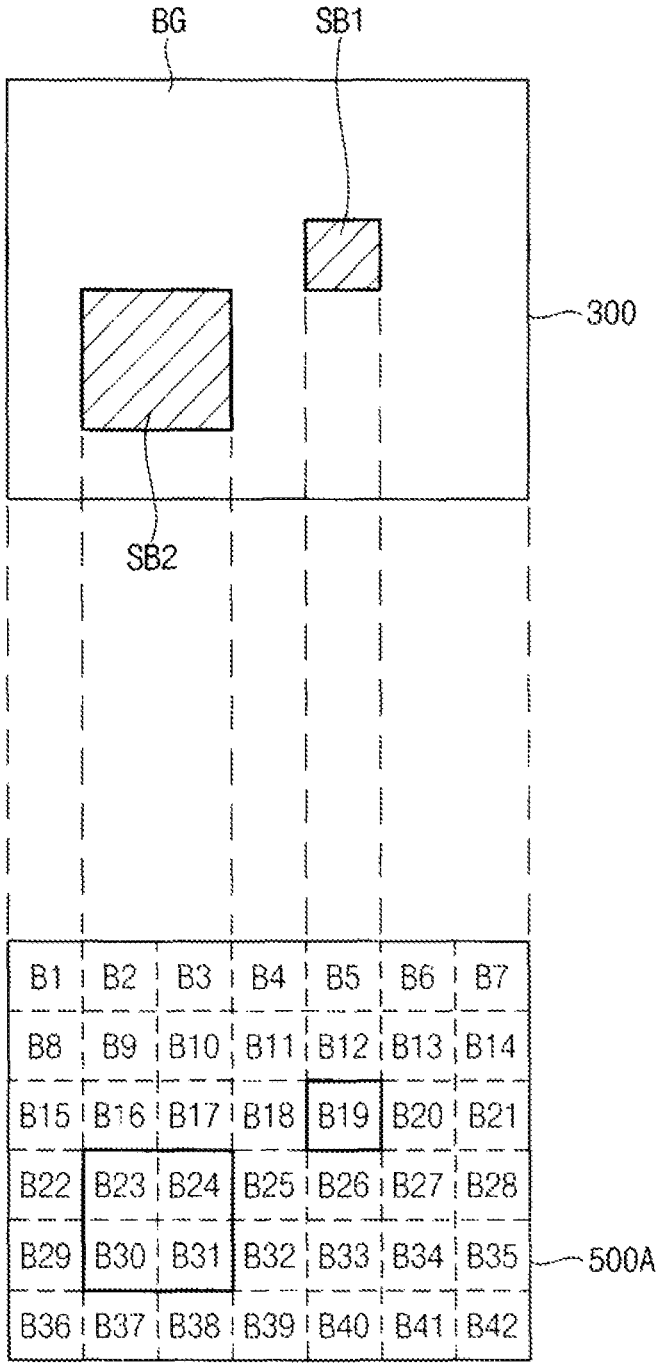

FIGS. 11A and 11B are conceptual diagrams illustrating a method of driving a light source part according to the method of controlling the light source of FIG. 10.

Referring to FIG. 11A, analysis by the local analyzing part 250 indicates that the pure color block SB is located at the center of the frame image displayed on the display panel 300. In this case, the luminance determining part 230 redetermines the luminances of the first light-emitting blocks B17, B18, B19, B24, B25 and B26 corresponding to the area on which the pure color block SB is displayed, resetting them at the maximum luminance level.

However, the luminance determining part 230 redetermines the luminances of the second light-emitting blocks B1 to B16, B20 to B23 and B27 to B42 corresponding to the area on which the background image BG is displayed, setting them at the luminance level that was determined based on the histogram.

The first light-emitting blocks corresponding to the pure color block SB are driven based on the maximum luminances, and the second light-emitting blocks corresponding to the background image BG are driven based on normal luminances. Thus, the luminance difference between the pure color block SB and the background image BG may be increased. Thus, the light-emitting blocks B1, B2, B3, . . . , B42 of the light source part 500A are individually driven so that the power consumption of the display apparatus may be reduced and the viewing quality of the pure color block SB with reference to the background image BG may be improved.

Referring to FIG. 11B, analysis by the local analyzing part 250 indicates that pure color blocks SB1 and SB2 are located in the frame image displayed on the display panel 300. In this case, the luminance determining part 230 sets the luminance level of a light-emitting block B19 corresponding to an area on which a first pure color block SB1 is displayed at the maximum luminance level. Similarly, the luminance determining part 230 sets the luminances of light-emitting blocks B23, B24, B30 and B31 corresponding to an area on which a second pure color block SB2 is displayed, at the maximum luminance level.

However, the luminance determining part 230 sets the luminances of light-emitting blocks B1 to B18, B20 to B22, B25 to B29 and B32 to B42 corresponding to the area on which the background image BG is displayed, as the determined luminance based on the histogram.

The light-emitting blocks corresponding to the first and second pure color blocks SB1 and SB2 are driven based on the maximum luminances and the light-emitting blocks corresponding to the background image BG are driven based on normal luminances. Thus, the luminance difference between the pure color blocks SB1 and SB2 and the background image may increase. In addition, the light-emitting blocks B1, B2, B3, . . . , B42 of the light source part 500A are individually driven so that the power consumption of the display apparatus may be reduced and the viewing quality of the pure color blocks SB1 and SB2 with reference to the background image BG may be improved.

As described above, according to the present invention, when the pure color block is displayed on the display panel including red, green, blue and white subpixels, the luminance level of the light source part providing the display panel with light is adjusted based on the local information including the location and the size of the pure color block(s) so that the power consumption of the display apparatus may be reduced.

In addition, according to the local information including the location and size of the pure color block, the luminance of the light-emitting block in the light source part corresponding to the pure color block is increased and the luminance of the light-emitting block in the light source part corresponding to the background image is relatively decreased. Thus, the power consumption of the display apparatus may be reduced and the viewing quality of the pure color block with reference to the background image may be improved.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention.

What is claimed is:

1. A method of controlling luminance of a light source, the method comprising:

generating red, green, blue and white data using red, green and blue data;

applying color weights to the red, the green, the blue and the white data according to contribution to luminance by each of the red, the green, the blue and the white data to generate pixel luminance data;

setting a luminance level of the light source having a plurality of light emitting blocks based on the pixel luminance data;

determining local information on a pure color block having pure and saturated color data in a frame image by using the pixel luminance data, wherein the local information includes one or more of presence, location, and size of the pure color block; and adjusting the luminance level of the plurality of light emitting blocks based on the local information on the pure color block.

2. The method of claim 1, wherein determining the local information on the pure color block comprises:

comparing the pixel luminance data with a pure color reference value to determine whether the pixel luminance data are pure color data;

determining a width of the pure color block based on the number of the pure color data continuously arranged in a horizontal line of the frame image; and determining a height of the pure color block based on the number of horizontal lines in which the pure color data are continuously arranged in the frame image.

3. The method of claim 2, wherein the luminance level of the light source is adjusted to be at maximum when the frame image includes no more than one pure color block.

4. The method of claim 2, wherein the luminance level of the light source is adjusted to be lower than a maximum luminance of the light source when the frame image includes a plurality of pure color blocks.

5. The method of claim 2, wherein the luminance level of the light source is adjusted such that the luminance of a first light-emitting block corresponding to the pure color block is higher than the luminance of a second light-emitting block corresponding to a background image of the frame image, wherein the light source includes a plurality of individually-drivable light-emitting blocks.

6. The method of claim 2, wherein the luminance level of the light source is adjusted such that the luminance of the light-emitting block corresponding to the pure color block is set to be at maximum, wherein the light source includes a plurality of individually drivable light-emitting blocks.

7. A display apparatus comprising:

a display panel including a red, a green, a blue and a white sub pixels and displaying an image;

a light source part providing light to the display panel and having a plurality of light emitting blocks; and a data processing circuit applying a color weight according to contribution to luminance by each of the red, the green, the blue and the white data to generate pixel luminance data, determining local information on a pure color block having pure and saturated color data included in the frame image by using the pixel luminance data, and adjusting the luminance level of the plurality of light emitting blocks based on the local information on the pure color block.

8. The display apparatus of claim 7, wherein the data processing circuit comprises:

a gamma mapping part generating red, green, blue and white data using red, green and blue data; and a luminance control part setting the luminance level of the light source based on a histogram of the pixel luminance data with respect to the frame image and adjusting the luminance level of the light source based on the local information on the pure color block.

9. The display apparatus of claim 8, wherein the luminance control part comprises:

a color weight part applying the color weight to each of the red, the green, the blue and the white data to generate the pixel luminance data;

a histogram analyzing part generating the histogram of the pixel luminance data with respect to the frame image;

a local analyzing part analyzing the local information on the pure color block using the pixel luminance data; and a luminance determining part determining the luminance of the light source part based on the histogram, and adjusting the luminance based on the local information on the pure color block.

10. The display apparatus of claim 9, wherein the local analyzing part compares the pixel luminance data with a pure color reference value to determine whether the pixel luminance data include the pure color data, determines a width of the pure color block based on the number of the pure color data continuously arranged in a horizontal line of the frame image, and determines a height of the pure color block based on the number of horizontal lines in which the pure color data is continuously arranged in the frame image.

11. The display apparatus of claim 9, wherein the luminance determining part adjusts the luminance level of the light source to be maximum when the frame image includes no more than one pure color block.

12. The display apparatus of claim 9, wherein the luminance determining part adjusts the luminance level to be lower than a maximum luminance of the light source part when the frame image includes a plurality of pure color blocks.

13. The display apparatus of claim 9, wherein the light source part includes a plurality of individually-drivable light-emitting blocks.

14. The display apparatus of claim 13, wherein the luminance determining part adjusts the luminance of a first light-emitting block corresponding to the pure color block to be higher than the luminance of a second light-emitting block corresponding to a background image of the frame image that does not include the pure color block.

15. The display apparatus of claim 13, wherein the luminance determining part adjusts the luminance of the light-emitting block corresponding to the pure color block to be at maximum level.

16. The display apparatus of claim 8, wherein the data processing circuit further comprises a scaler correcting grayscales of the red, the green, the blue and the white data based on the luminance level set by the light source luminance control part.

17. The display apparatus of claim 16, wherein the scaler corrects the grayscales of the red, the green, the blue and the white data corresponding to a background image of the frame image to relatively lower luminance grayscales.

18. The display apparatus of claim 16, wherein the scaler applies the grayscales of the red, the green, the blue and the white data corresponding to a background image of the frame image without any alteration.

19. The display apparatus of claim 16, wherein the data processing circuit further comprises a rendering part reconstructing the red, the green, the blue and the white data to generate the red and green data or the blue and white data using data preceding or succeeding the red, the green, the blue and the white data.

* * * * *